US007540155B2

(12) United States Patent
Taut

(10) Patent No.: US 7,540,155 B2
(45) Date of Patent: Jun. 2, 2009

(54) THERMAL SHIELD STONE FOR COVERING THE WALL OF A COMBUSTION CHAMBER, COMBUSTION CHAMBER AND A GAS TURBINE

(75) Inventor: Christine Taut, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 1349 days.

(21) Appl. No.: 10/399,260

(22) PCT Filed: Oct. 4, 2001

(86) PCT No.: PCT/EP01/11471

§ 371 (c)(1),
(2), (4) Date: Apr. 16, 2003

(87) PCT Pub. No.: WO02/33322

PCT Pub. Date: Apr. 25, 2002

(65) Prior Publication Data

US 2004/0050060 A1 Mar. 18, 2004

(30) Foreign Application Priority Data

Oct. 16, 2000 (EP) ..... 00122553

(51) Int. Cl.
*F02C 1/00* (2006.01)
*F02G 3/00* (2006.01)

(52) U.S. Cl. ..... 60/752; 60/753; 110/336; 428/610

(58) Field of Classification Search ..... 60/752, 60/753; 110/336; 431/350, 353; 428/547, 428/610

See application file for complete search history.

(56) References Cited

U.S. PATENT DOCUMENTS

| | | | | | |
|---|---|---|---|---|---|
| 4,101,712 | A | * | 7/1978 | Bomford et al. | 428/547 |
| 4,168,182 | A | * | 9/1979 | Rossmann et al. | 148/99 |
| 4,321,311 | A | | 3/1982 | Strangman | |
| 4,401,480 | A | * | 8/1983 | Crombie, III | 148/676 |
| 4,641,588 | A | * | 2/1987 | Winter et al. | 110/203 |
| 4,659,547 | A | | 4/1987 | Svensson et al. | |
| 4,768,445 | A | * | 9/1988 | Vollhardt et al. | 110/336 |
| 4,810,677 | A | | 3/1989 | Heinze et al. | |
| 4,996,117 | A | * | 2/1991 | Chu et al. | 428/633 |
| 5,174,368 | A | * | 12/1992 | Boury et al. | 60/753 |

(Continued)

FOREIGN PATENT DOCUMENTS

WO 9853940 12/1998

OTHER PUBLICATIONS

Niino et al.; "Projected Research on High-Efficiency Energy Conversion Materials" pp. 601-605.

(Continued)

*Primary Examiner*—Ted Kim
(74) *Attorney, Agent, or Firm*—Harness, Dickey & Pierce

(57) ABSTRACT

A thermal shield stone for covering the wall of a combustion chamber. The stone includes a hot side which can be exposed to a hot medium and a wall side which is arranged opposite the hot side. A hot side area adjoins the hot side. The wall side adjoins a wall side area. The average particle size in the wall side area is smaller than in the hot side area.

28 Claims, 3 Drawing Sheets

U.S. PATENT DOCUMENTS

| | | | | |
|---|---|---|---|---|
| 5,339,637 | A * | 8/1994 | Schetter | 60/753 |
| 5,625,153 | A * | 4/1997 | Sawai et al. | 73/762 |
| 5,647,202 | A * | 7/1997 | Althaus | 60/752 |
| 6,322,897 | B1 * | 11/2001 | Borchert et al. | 428/469 |

OTHER PUBLICATIONS

Henning et al.; "Ceramic Gradient Materials for Components of Internal Combustion Engines"; (in German with English abstract); May 1992; pp. 436-439.

* cited by examiner

THERMAL SHIELD STONE FOR COVERING THE WALL OF A COMBUSTION CHAMBER, COMBUSTION CHAMBER AND A GAS TURBINE

This application is the national phase under 35 U.S.C. § 371 of PCT International Application No. PCT/EP01/11471 which has an International filing date of Oct. 4, 2001, which designated the United States of America and which claims priority on European Patent Application number EP 00122553.1 filed Oct. 16, 2000, the entire contents of which are hereby incorporated herein by reference.

FIELD OF THE INVENTION

The invention generally relates to a heat shield brick or stone. In particular, it preferably relates to one for lining a combustion chamber wall, having a hot side, which can be exposed to a hot medium, and a wall side, which is on the opposite side from the hot side. The heat shield brick preferably has a hot-side region, which adjoins the hot side, and a wall-side region, which adjoins the wall side. The invention also generally relates to a combustion chamber with an inner combustion chamber lining and to a gas turbine.

BACKGROUND OF THE INVENTION

To make a component which is exposed to extremely high temperatures, for example a heat shield element, such as a heat shield brick or a gas turbine blade or vane, able to withstand heat, it is known, for example from U.S. Pat. No. 4,321,311, to produce the component from a metallic base body and to coat the metallic base body with a ceramic thermal barrier coating of $ZrO_2$. The ceramic thermal barrier coating is bonded in place by a metallic bonding layer made from an alloy of the MCrAlY type. Since the ceramic thermal barrier coating is generally a good conductor of oxygen ions, during operational use of the component, the bonding layer is partially oxidized, which can cause the thermal barrier coating to become detached from the metallic base body. Consequently, the duration of use of a component of this type is limited. This is the case in particular in the event of frequent temperature changes which occur when a gas turbine is being started up and stopped.

To improve the ability of piston heads to withstand temperature changes, the article "Keramische Gradientenwerkstoffe für Komponenten in Verbrennungsmotoren" [Ceramic gradient materials for components used in internal combustion engines] by W. Henning et al. in Metall, 46th Edition, Volume 5, May 1992, pages 436 to 439, has described a fiber ceramic body with a density gradient. This fiber ceramic body is composed of four layers of differing layer thickness with differing ceramic contents. The difference in the ceramic content consists in the ratio of fibers ($Al_2O_3$ short fibers) to ceramic particles of $Al_2TiO_5$ differing significantly in the four layers. Consequently, the porosity of the four layers also differs significantly from one another. The high porosity of the layers of between 40% and 79% is used to introduce molten metal into the voids in the fiber ceramic body by means of squeeze casting in order to produce a defect-free composite. In this way, it is possible to produce a piston head which has a metal and ceramic gradient which changes considerably and suddenly. The low thermal conductivity of the ceramic contents leads to the formation of a thermal barrier, thus insulating the piston. Moreover, the fiber ceramic mechanically reinforces the piston and thereby improves the ability of the piston to withstand thermal shocks.

The article "Projected Research on High Efficiency Energy Conversion Materials", by M. Niino, M. Koizumi in FGM 94, Proceedings of the 3$^{rd}$ International Symposium on Functional Gradient Materials, ed. B. Ilschner, N. Cherradi, pp. 601-605, 1994 has described composite materials in relation to the development of materials for an orbital glider, and these materials are referred to as functional gradient materials (FGMs). A significant feature of FGMs is a continuous composition and/or microstructure gradient, which is intended to lead to a continuous gradient of the relevant function, e.g. the strength, thermal conductivity, ductility and the like, the intention being to increase the load-bearing capacity and efficiency of the material by avoiding abrupt changes in properties. Therefore, FGMs are intended to combine the positive properties of layer and single-piece composites in one material.

WO 98/53940 has disclosed a metal-ceramic gradient material, in particular for a heat shield or a gas turbine blade or vane. The metal-ceramic gradient material has a metallic base material, and also includes a ceramic and an additive for high-temperature oxidation resistance. In this case, the concentration of the metallic base material decreases from a metal-rich zone to a ceramic-rich zone, the concentration of the additive having a concentration gradient. Furthermore, WO 98/53940 has described a process for producing a metal-ceramic gradient material and a product produced therefrom, for example a gas turbine blade or vane or a heat-protection element of a gas turbine.

SUMMARY OF THE INVENTION

It is an object of an embodiment of the invention to provide an improved heat shield brick, in particular for lining a combustion chamber wall. The heat shield brick is to be designed in particular with a view to the different demands imposed on the hot side, which can be exposed to a hot medium, e.g. a hot gas, and the wall side, which is on the opposite side from the hot side. A further object of an embodiment of the invention is to provide a combustion chamber having an inner combustion chamber lining, and a gas turbine.

The first object may be achieved, according to an embodiment of the invention, by a heat shield brick, in particular for lining a combustion chamber wall, having a hot side, which can be exposed to a hot medium, and a wall side, which is on the opposite side from the hot side, and having a hot-side region which adjoins the hot side, and a wall-side region, which adjoins the wall side, in which heat shield brick the mean grain size in the wall-side region is smaller than in the hot-side region.

An embodiment of the invention is based on an observation that the demands imposed on the hot side of heat shield bricks and those imposed on the wall side, which is the opposite side from the hot side, differ. When a heat shield brick is in operation, the heat shield bricks are used, for example, in combustion chambers of stationary gas turbines and are used to thermally insulate the combustion chamber wall, which is usually metallic. The wall side of a heat shield brick is secured adjacent to the combustion chamber wall by means of a bearing structure. In operation, the hot side is exposed to a hot medium, for example the hot combustion gas. On account of the conditions of use, therefore, the demands imposed on the hot side of the heat shield bricks are significantly different from those imposed on the wall side, which is at a much lower temperature. In a gas turbine combustion chamber, the hot side of the heat shield bricks is exposed to a high load from fast-flowing, corrosive hot gases which are typically at temperatures of approximately 1500° C. Moreover, it is often necessary to cope with sudden temperature changes of up to 1000° C. resulting from loads being applied to and removed from the gas turbine. The desired service lives of the bricks under these conditions are approx. 50,000 hours of operation.

An embodiment of the invention takes a new route aimed at combining the in some cases contradictory requirements, for example a high strength on the wall side and, by contrast, the ability to withstand high thermal stresses, temperature resistance and ability to withstand temperature changes on the hot side, more successfully with one another by use of the proposed heat shield brick. The relevant key regions, namely the hot-side region of the heat shield brick, which adjoins the hot side, and the wall-side region of the heat shield brick, which adjoins the wall side, are matched to the prevailing demands in a targeted fashion in terms of their structure. In this case, the grain size distribution in the hot-side region and in the wall-side region are matched to the corresponding thermomechanical loads in a manner which is specific to the individual regions.

The structural parameter selected to be adjusted is the grain size in the wall-side region and in the hot-side region; the mean grain size in the wall-side region is smaller than in the hot-side region. In this context, the term mean grain size is understood as meaning the mean of the grain size diameter distribution in a corresponding region. A grain size structuring of the individual regions which is matched to the prevailing requirements results in a heat shield brick which is matched to the load and is improved compared to conventional heat shield elements. In this context, in particular the requirements of a high ability to withstand thermal shock in the hot-side region and a high strength in the wall-side region can be combined with one another in a single heat shield brick.

In this case, the heat shield brick may advantageously include a single material, for example a refractory material, in which it is merely necessary to set the different grain sizes in the wall-side region and in the hot-side region. The desired result is achieved just be adapting the structure of the heat shield brick. However, it is also eminently possible to select a brick having different chemical compositions, for example a mixture of two or more substances, and to effect the structural matching in terms of the grain size in the wall-side region and in the hot-side region in accordance with an embodiment of the invention in a suitable way. An embodiment of the invention is therefore distinguished by a high degree of flexibility, since the relevant parameter, namely the grain size distribution or the arithmetic mean thereof, is a structural parameter which a priori can be influenced independently of the chemical composition and can therefore be set with a view to satisfying the above demands.

The grain size in the wall-side region is preferably smaller than in the hot-side region by approximately a factor of 0.4 to 0.9, in particular a factor of 0.6 to 0.8. These scaling factors enable the grain size in the hot-side region and in the wall-side region to be set relative to one another, so that the absolute dimensions of the heat shield brick and the relevant load regions (hot-side region, wall-side region) are substantially irrelevant. This advantageously makes it possible to produce heat shield bricks of different geometries, material thicknesses or compositions with grain size matching which is specific to the load region.

The mean grain size in the hot-side region is preferably between approximately 1.5 mm and 3.5 mm. In particular, the mean grain size in the hot-side region is greater than approximately 2 mm.

The mean grain size in the wall-side region is preferably between approximately 0.6 mm and 1.4 mm. The mean grain size in the wall-side region is in particular less than approximately 1.2 mm.

If the grain size is dimensioned in accordance with the above limits, it is possible in particular to provide heat shield bricks with dimensions such as those which are customarily relevant when a heat shield brick is used in the combustion chamber of a gas turbine in such a manner as to satisfy the load demands. Of course, the thermomechanical load in the wall-side region and in the hot-side region can be determined empirically and/or by calculation for specific instances, so that a grain size which precisely matches the corresponding loads can be provided in the corresponding regions.

In a particularly preferred configuration, layers with a decreasing grain size are provided in a direction from the hot side toward the wall side.

In this case, a mean grain size is set in each of the layers, so that the mean grain size decreases in layers from the hot-side region toward the wall-side region. In this case, it is preferable for one grain size to be set in each layer. This layered change in the grain sizes set in the layers is advantageously gradual, so that unacceptably large changes (sudden jumps) in the materials properties are substantially avoided and it is possible to achieve a heat shield brick with properties which are suitably matched to the demands. The relevant materials properties, e.g. strength, thermal conductivity, ductility and the like, can, on account of the avoidance of sudden changes in properties, produce an increase in the load-bearing capacity and efficiency of the heat shield brick. The wall-side region and/or the hot-side region may advantageously have a layer with suitably adapted grain sizes.

The number of layers is preferably in this case approximately 5 to 30, in particular approximately 10 to 20. The precise number of layers selected will depend on the specific load and on the gradual adjustment of the grain size which is required from the hot-side region to the wall-side region. In process engineering terms, a heat shield brick of this type having a structure gradient which is adjusted in terms of the grain size can be produced by a powder comprising a base material for the heat shield brick, for example a ceramic or other refractory material, being poured in successive layers to form a bed of bulk material and the bed of bulk material then being suitably pressed and sintered to form the heat shield brick which has a structure gradient, the mean grain size in the wall-side region being lower than in the hot-side region, and the grain size being gradually adjusted according to the number of layers.

It is preferable for the grain size to change substantially continuously in a direction from the hot side toward the wall side.

A continuous change in the grain size is particularly advantageous since it makes it possible to avoid virtually any abrupt changes in the relevant materials properties during the transition from the wall-side region to the hot side region. A quasi-continuous adjustment can be achieved by using a correspondingly high number of layers.

In production engineering terms, continuous adjustment of this type is correspondingly more complex. A continuous or quasi-continuous transition of the grain size distribution (mean grain size diameter distribution) may in this case, by way of example, take place using a linear function. In general, however, this transition can also be achieved using higher-order polynomials or other continuous or continuously differentiable functions. A suitable choice can be made according to the particular load and load profile from the hot side to the wall side of the heat shield brick, and corresponding functions can be used to adjust the transition.

In a particularly preferred configuration, the heat shield brick is composed of at least two substances, comprising a first substance and a second substance which is different than the first substance.

This configuration can advantageously also be used to configure heat shield bricks which consist of at least a two-substance mixture with a region-specific grain size adjustment in accordance with the basic concept of the invention. In addition to two-substance mixtures, heat shield bricks which are composed of more than two chemical compounds can also be structured in terms of their grain size distribution.

In this case, the concentration of the first substance is preferably higher in the wall-side region than in the hot-side region.

As a result, the advantages of structural adjustment of grain size in the hot-side region and in the wall-side region are advantageously combined with chemical matching in terms of the concentration of the first substance in the wall-side region and in the hot-side region. With two-substance mixtures, the structural stepped transition is complemented by a chemical stepped transition which, like the structural transition, can also be carried out gradually using a layer system or substantially continuously from the hot-side region to the wall-side region.

The stepped transition in the grain size and chemical composition particularly advantageously makes it possible to avoid abrupt changes in the materials properties. As a result, the matching of the heat shield brick to the thermomechanical requirements is improved further. The grain size and concentration adjustment results in a multidimensional parameter range for designing a heat shield brick in a manner specific to the load regions.

The first substance, of which there is a higher concentration in the wall-side region than in the hot-side region, advantageously has properties which increase the strength in the wall-side region compared to the strength in the hot-side region, since, on account of the demands arising, for example, when the heat shield brick is used in the combustion chamber of a gas turbine, the wall-side region requires the greater strength. By contrast, the strength requirement in the hot-side region is of subordinate importance compared to the ability to withstand thermal shocks in the hot-side region. Therefore, the concentration of the first substance in the hot-side region is advantageously to be set at a lower level than in the cold-side region. The adjustment of the concentration, i.e. the concentration gradient of the first substance and/or the second substance, advantageously takes place gradually in corresponding layers or else the concentration is adjusted continuously.

It is preferable for the first substance to be an oxide and the second substance a silicate, in particular a silicate ceramic.

Preferably, the first substance is aluminum oxide $Al_2O_3$ and the second substance aluminum silicate $3Al_2O_3.2SiO_2$.

Heat shield bricks of a quality which contain aluminum silicate $3Al_2O_3.2SiO_2$ and aluminum oxide $Al_2O_3$ have proven particularly well-suited to use under the conditions described above. The aluminum oxide may in this case be introduced in the form of (coarse crystalline) corundum. Aluminum oxide forms very hard, colorless crystals and has a melting point at 2050° C. It is therefore particularly suitable for high-temperature applications as part of a heat shield brick. Aluminum silicate $3Al_2O_3.2SiO_2$, also known as mullite, is formed, for example, by firing (heating) shaped, wet clay, if appropriate with additions of quartz sand and feldspar, until sintering or fusion takes place. Heat shield bricks which at least include aluminum oxide and aluminum silicate can be well matched in terms of the grain size in the hot-side region and in the wall-side region and in terms of the concentration levels of the two substances.

In this case, in particular the mullite content can be lower compared to the aluminum oxide content in the wall-side region than in the hot-side region. The mullite content in the wall-side region may preferably be significantly lower than the aluminum oxide content. In particular, the aluminum oxide content may be the dominant fraction in the wall-side region in terms of the composition of the heat shield brick. Preferably, the wall-side region may also predominantly comprise aluminum oxide, in particular may almost exclusively consist of aluminum oxide. It is also preferable for the mullite content to be greater than the aluminum oxide content in the hot-side region. In particular, the mullite content in the hot-side region is so much greater than the aluminum oxide content that in particular the mullite fraction is the dominant constituent of the heat shield brick in the hot-side region. In a particularly preferred configuration, the hot-side region consists almost exclusively of mullite.

A heat shield brick which has been configured preferably in accordance with the above statements, with the mullite content dominant in the hot-side region and the aluminum oxide content dominant in the wall-side region, advantageously has a high strength in the wall-side region, combined, at the same time, with a high ability to withstand thermal shocks in the hot-side region.

In a particularly preferred configuration, the first substance is a ceramic and the second substance a metal. This advantageously also enables heat shield bricks which include metal, such as for example those which are described in WO 98/53940 with a metal-ceramic gradient material, to be improved with a view to grain size matching which is specific to the load region. The concept of the invention can therefore be applied to a wide range of different chemical compositions of heat shield bricks.

According to an embodiment of the invention, an object relating to a combustion chamber may be achieved by a combustion chamber having an inner combustion chamber lining which includes heat shield bricks in accordance with the statements made above.

According to an embodiment of the invention, an object relating to a gas turbine may be achieved by a gas turbine having a combustion chamber which includes heat shield bricks of this type.

The advantages of a combustion chamber of this type and of a gas turbine of this type are in accordance with the statements made in connection with the heat shield bricks.

BRIEF DESCRIPTION OF THE DRAWINGS

The invention is explained in more detail by way of example with reference to the drawing, in which, diagrammatically and in some cases in simplified form.

Identical reference symbols have the same meaning throughout the various figures.

DETAILED DESCRIPTION OF THE PREFERRED EMBODIMENTS

Figure 1:
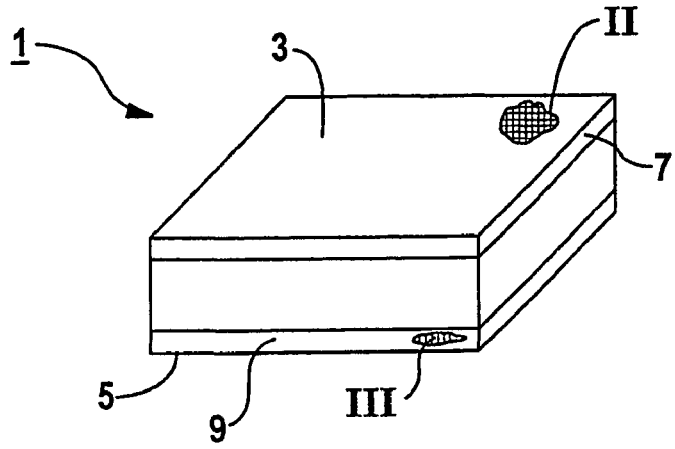
FIG. 1 shows a perspective illustration of a heat shield brick.

FIG. 1 shows a perspective illustration of a heat shield brick 1. The heat shield brick 1 has a cuboidal geometry, with a hot side 3 and a wall side 5 on the opposite side from the hot side. The hot side 3 is adjoined by a hot-side region 7. The wall side 5 is adjoined by a wall-side region 9. The hot-side region 7 and the wall-side region 9 each extend from the hot side 3 or the wall side 5 into the interior of the cuboidal heat shield brick 1. In the wall-side region 9 and in the hot-side region 7, the material of which the heat shield brick 1 is composed, for example a refractory ceramic, in each case has a grain size distribution. The grain size distribution is set in such a way that the mean grain size D in the wall-side region 9 is smaller than in the hot-side region 7.

This structural configuration of the heat shield brick 1 indicates that the latter has regions which are specifically matched to the prevailing thermomechanical demands. Particularly when the heat shield brick 1 is used in a combustion chamber, for example a combustion chamber of a gas turbine, the demands imposed on the heat shield brick 1 in the hot-side region 7 and the wall-side region 9 differ. With the targeted grain size adjustment in accordance with the invention, it is possible for the in some cases competing requirements in the hot-side region 7 and in the wall-side region 9 to be satisfied equally well and to achieve significant improvements over conventionally designed heat shield bricks 1. As a result, by way of example, a high strength is achieved in the wall-side region 9, and a particularly good resistance to high thermal stresses, thermal loads and loads resulting from temperature changes (ability to withstand thermal shocks) is achieved in the hot-side region 9. The heat shield brick 1 is therefore designed for high-temperature applications and to be acted on by a corrosive, hot medium, for example a hot gas, at temperatures of up to 1500° C.

Figure 2:
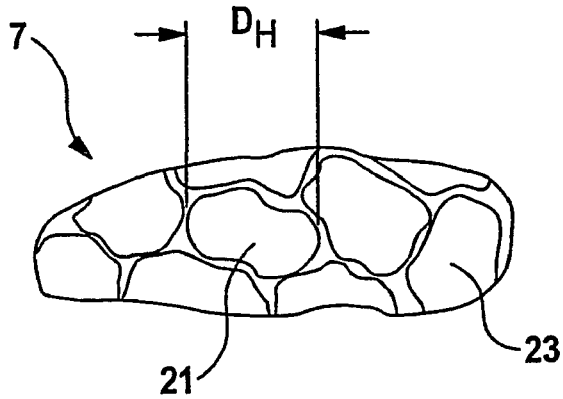
FIG. 2 shows an enlarged view of the detail II shown in FIG. 1.
Figure 3:
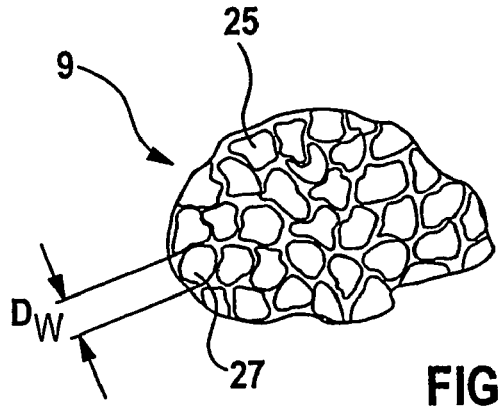
FIG. 3 shows an enlarged view, similar to that presented in FIG. 2, of the detail III shown in FIG. 1.

To illustrate the different grain sizes in the hot-side region 7 and in the cold-side region 9, FIGS. 2 and 3 each show an enlarged illustration of details II and III, respectively. Details X1, X2 are in this case enlarged by approximately the same factor compared to the illustration presented in FIG. 1. FIG. 2 shows detail II, i.e. an enlarged excerpt from the hot-side region 7 of the heat shield brick 1. The hot-side region 7 has a grain structure with a multiplicity of grains 21, 23 which adjoin one another. The assembly of a large number of grains 21, 23 can be tested in terms of its grain size D, i.e. the grain size diameter. In this case, the grain size in the hot-side region 7 has a mean size $D_H$. For comparison purposes, FIG. 3 shows, by detail III, an excerpt of a grain structure which is established in the wall-side region 9 of the heat shield brick 1 according to the invention. The grain structure in the wall side region 9 has a multiplicity of grains 25, 27 which adjoin one another and form a microstructure in the wall-side region 9. The grain size $D_W$ in the wall-side region 9 is in this case smaller than the grain size $D_H$ in the hot-side region 7.

Figure 4:
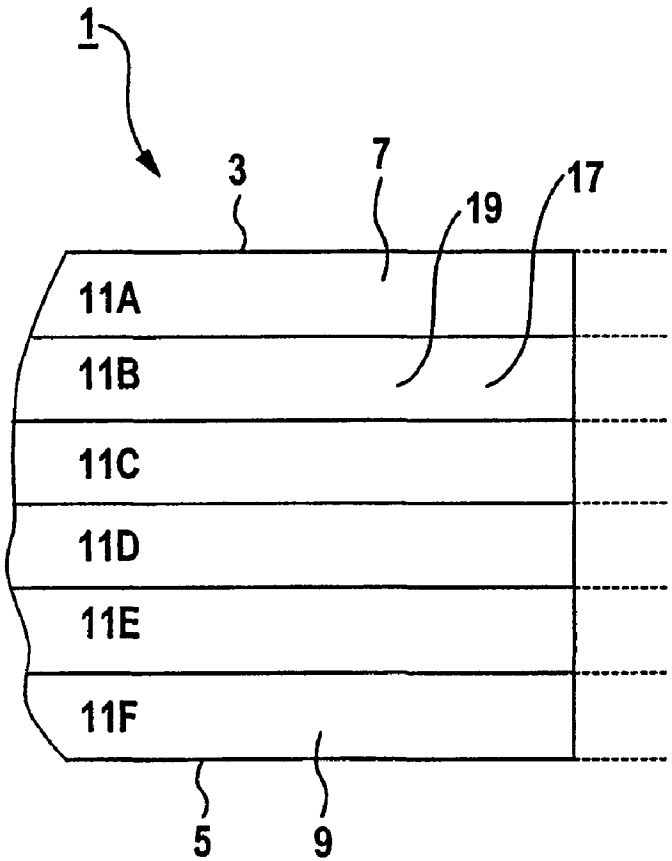
FIG. 4 shows a side view of part of a heat shield brick with a layer structure.

FIG. 4 shows part of a diagrammatic side view of a heat shield brick 1. In this context, to facilitate comparison, reference is also made to FIG. 5. Layers 11A to 11F are provided in a direction 13 from the hot side 3 toward the wall side 5 of the heat shield brick. The hot-side region 7 in this case comprises a layer 11A assigned to the hot side 3, while the wall-side region 9 includes a layer 11F assigned to the wall side 5. The heat shield brick 1 is in this case composed of at least two substances 17, 19, a first substance 17 and a second substance 19, which is different than the first substance, being incorporated in the heat shield brick 1.

Figure 5:
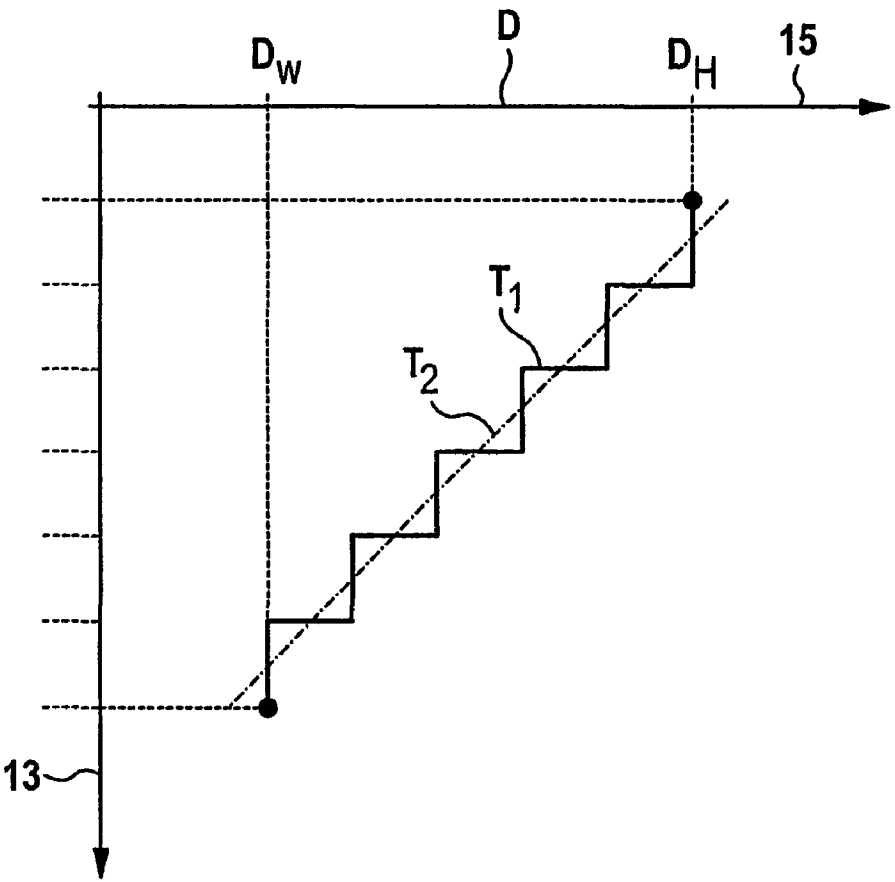
FIG. 5 shows a diagram illustrating the profile of the grain size of the heat shield brick shown in FIG. 4*a*.

FIG. 5 shows a diagram which presents a graph illustrating the mean grain size D in the direction 13 from the hot side 3 toward the wall side 7 (vertical axis). The layer sequence of the layers 11A to 11F is shown along the directional axis 13. The grain size D is plotted on axis 15 (horizontal axis). In the hot-side region 7, which includes the layer 11A, the heat shield brick 1 has a grain size $D_H$. In the wall-side region 9, which comprises the layer 11F, the heat shield brick 1 has a mean grain size $D_W$. The grain size $D_W$ is smaller than the grain size $D_H$. Furthermore, a respective grain size D is set in the intermediate layers 11B to 11E which are located between the layer 11A and the layer 11F. In this case, the grain size D accordingly decreases in layers from the hot side 3 toward the wall side 5. Therefore, a gradual, in particular stepped adjustment of the grain size D is achieved in the direction 13 from the hot side 3 toward the wall side 5, with the result that the relevant materials properties of the heat shield brick 1, e.g. strength, thermal conductivity, ductility, inter alia are also correspondingly gradually adjusted with respect to one another. This avoids abrupt property changes and considerably increases the efficiency of the material which forms the heat shield brick 1 and its ability to withstand loads.

FIG. 5 shows possible variants for the profile of the grain size D as a function of the layer sequence 11A to 11F in simplified form. In this context, curve $T_1$ represents a gradual, in particular stepped adjustment of the grain size D from the smaller grain size $D_W$ to the larger grain size $D_H$, as are set in regions 7, 9, respectively. However, if there is a suitably large number of layers 11A to 11F, it is also possible to adjust the grain size D in a direction 13 from the hot side 3 toward the wall side 9 by means of a continuous or at least quasi-continuous function. To illustrate this fact, the diagram shown in FIG. 5 presents a further curve $T_2$. The curve $T_2$ represents a linear adjustment along directional axis 13. In this case, the grain size D changes linearly from $D_H$ to $D_W$ along directional axis 13 from the hot-side region 7 to the wall-side region 9. However, other adjustments to the grain size D along the directional axis 13 are also possible in addition to curves $T_1$ and $T_2$. For example, adjustments by means of higher-order polynomials or if desired other continuous or continuously differentiable functions are possible. This can be adjusted in each case as a function of the prevailing load and as a function of the thermomechanical demands imposed on the heat shield brick 1.

In addition to the adjustment of the grain size D, it is possible, in particular in the case of a two-substance mixture, to suitably adjust the concentrations of the chemical constituents, namely of the first substance 17 and of the second substance 19, in the heat shield brick 1. This combination of structural and chemical adjustment of the heat shield brick 1 makes it possible in particular to achieve a high ability to withstand thermal shocks in the hot-side region 7 combined with a high strength in the wall-side region 9. The first substance 17 used is, for example, aluminum oxide $Al_2O_3$, while the second substance 19 used is mullite. The concentration of the first substance 17 and/or of the second substance 19 may change along the directional axis 13 from the wall side 3 toward the hot side 5 in a manner which is suitably adapted to the load.

When it is used in a gas turbine, for example, the hot side 3 is exposed to a hot aggressive medium, the hot gas, and the concentration of the first substance 17, e.g. aluminum oxide $Al_2O_3$, is set to be greater in the wall-side region 9 than in the hot-side region 7. In the hot-side region 7, the concentration of the second substance 19, for example mullite, is greater than the concentration of the first substance 17 (e.g. aluminum oxide $Al_2O_3$). By way of example, in a two-substance mixture, the concentration of the first substance 17, for example aluminum oxide $Al_2O_3$, may be virtually 100% in the wall side region 9, while the concentration of the second substance 19, e.g. mullite, may be virtually 100% in the hot-side region 7.

Figure 6:
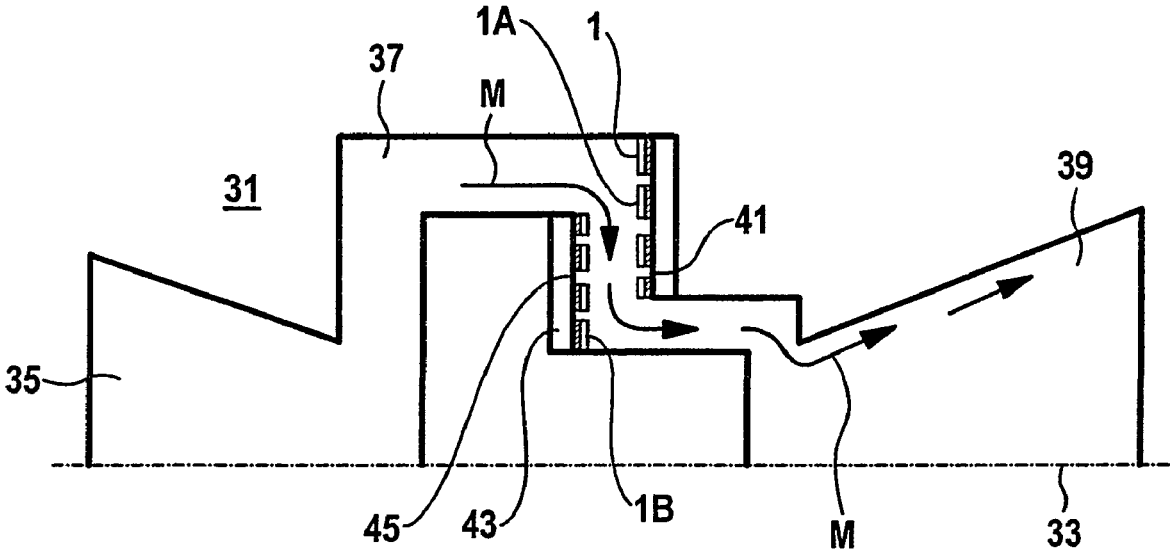
FIG. 6 shows a greatly simplified longitudinal section through a gas turbine.

FIG. 6 shows a highly diagrammatic, simplified illustration of a longitudinal section through a gas turbine 31. The following are arranged in succession along a turbine axis 33: a compressor 35, a combustion chamber 37 and a turbine part 39. The combustion chamber 37 is lined on the inside with a combustion chamber lining 41. The combustion chamber 37 has a combustion chamber wall 43. The combustion chamber wall 43 forms a bearing structure 45. The combustion chamber 37 has heat shield bricks 1, 1A, 1B in accordance with the statements made above.

In this case, the heat shield bricks 1, 1A, 1B are secured to the bearing structure 45, with their wall side 5 facing the bearing structure 45, by means of suitable securing elements (not shown in more detail). When the gas turbine 31 is operating, at least the hot side 3 of the heat shield bricks 1, 1A, 1B is acted on by a hot medium M, the hot gas of the gas turbine. Particularly in the case of a gas turbine 31, there may be considerable vibrations, for example resulting from combustion chamber humming. In the event of resonance, even shock-like acoustic combustion chamber vibrations having large vibration amplitudes may occur. These vibrations lead to considerable stressing of the combustion chamber lining 41. This affects both the bearing structure 45 and the heat shield bricks 1, 1A, 1B. Shocks above all endanger the heat shield bricks 1A, 1B, in particular on account of the risk of fracture which is present. Furthermore, the heat shield bricks 1, 1A, 1B are subject to particularly strong thermal loads, in particular on the hot side 3 which is acted on by the hot gas M. Designing the heat shield bricks 1, 1A, 1B with a grain size D which is set to match the loads in the specific regions, and preferably also with a variation in the chemical composition in the case of a two-substance system results in a heat shield brick 1, 1A, 1B which is matched to the prevailing demands being installed in the combustion chamber 37. The result of this is that the combustion chamber lining 41 is particularly insensitive to shocks or vibrations or thermal loads, in particular loads resulting from temperature changes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A heat shield brick, comprising:

a hot side, adapted to be exposed to a hot medium;

a wall side, on an opposite side from the hot side;

a hot-side region, adjoining the hot side; and a wall-side region, adjoining the wall side, wherein a mean grain size in the wall-side region is relatively smaller than a mean grain size in the hot-side region, wherein layers of decreasing grain size are provided in a direction from the hot side toward the wall side, so that a stepped adjustment of the grain size is achieved, wherein the heat shield brick includes at least a first substance and a second substance different from the first substance, wherein a concentration of the first substance in the wall-side region is relatively greater than in the hot-side region, and wherein the first substance is an oxide and the second substance is a silicate.

2. The heat shield brick as claimed in claim 1, wherein the grain size in the wall-side region is relatively smaller than in the hot-side region by approximately a factor of 0.4 to 0.9.

3. The heat shield brick as claimed in claim 2, wherein the mean grain size in the hot-side region is between approximately 1.5 mm and 3.5 mm.

4. The heat shield brick as claimed in claim 2, wherein the mean grain size in the hot-side region is greater than approximately 2 mm.

5. The heat shield brick as claimed in claim 2, wherein the mean grain size in the wall-side region is less than approximately 1.2 mm.

6. The heat shield brick as claimed in claim 2, wherein the mean grain size in the wall-side region is between approximately 0.6 mm and 1.4 mm.

7. The heat shield brick as claimed in claim 1, wherein the mean grain size in the hot-side region is between approximately 1.5 mm and 3.5 mm.

8. The heat shield brick as claimed in claim 7, wherein the mean grain size in the wall-side region is between approximately 0.6 mm and 1.4 mm.

9. The heat shield brick as claimed in claim 7, wherein the mean grain size in the wall-side region is less than approximately 1.2 mm.

10. The heat shield brick as claimed in claim 1, wherein the mean grain size in the wall-side region is between approximately 0.6 mm and 1.4 mm.

11. The heat shield brick as claimed in claim 1, wherein the number of layers is approximately 5 to 30.

12. The heat shield brick as claimed in claim 1, wherein the grain size changes substantially continuously in a direction from the hot side toward the wall side.

13. The heat shield brick as claimed in claim 1, wherein the first substance is aluminum oxide $Al_2O_3$ and the second substance is aluminum silicate $3Al_2O_3 \cdot 2SiO_2$.

14. The heat shield brick as claimed in claim 1, wherein the first substance is a ceramic .

15. A combustion chamber comprising an inner combustion-chamber lining including at least one heat shield brick as claimed in claim 1.

16. A gas turbine comprising the combustion chamber as claimed in claim 15.

17. The heat shield brick as claimed in claim 1, wherein the heat shield brick is for lining a combustion chamber wall.

18. The heat shield brick as claimed in claim 1, wherein the grain size in the wall-side region is relatively smaller than in the hot-side region by approximately a factor of 0.6 to 0.8.

19. The heat shield brick as claimed in claim 1, wherein the mean grain size in the hot-side region is greater than approximately 2 mm.

20. The heat shield brick as claimed in claim 1, wherein the mean grain size in the wall-side region is less than approximately 1.2 mm.

21. The heat shield brick as claimed in claim 1, wherein the number of layers is approximately 10 to 20.

22. The heat shield brick as claimed in claim 1, wherein the second substance is a silicate ceramic.

23. A combustion chamber comprising at least one wall, the wall including at least one heat shield brick, the brick including, a hot side, adapted to be exposed to a hot medium;

a wall side, on an opposite side from the hot side;

a hot-side region, adjoining the hot side; and a wall-side region, adjoining the wall side, wherein a mean grain size in the wall-side region is relatively smaller than a mean grain size in the hot-side region, wherein layers of decreasing grain size are provided in a direction from the hot side toward the wall side, so that a stepped adjustment of the grain size is achieved, wherein the heat shield brick includes at least a first substance and a second substance different from the first substance, wherein a concentration of the first substance in the wall-side region is relatively greater than in the hot-side region, and wherein the first substance is an oxide and the second substance is a silicate.

24. The combustion chamber as claimed in claim 23, wherein the grain size in the wall-side region is relatively smaller than in the hot-side region by approximately a factor of 0.4 to 0.9.

25. The combustion chamber as claimed in claim 24, wherein the mean grain size in the hot-side region is between approximately 1.5 mm and 3.5 mm.

26. The combustion chamber as claimed in claim 24, wherein the mean grain size in the wall-side region is between approximately 0.6 mm and 1.4 mm.

27. A gas turbine comprising the combustion chamber as claimed in claim 24.

28. The combustion chamber as claimed in claim 23, wherein the number of layers is approximately 5 to 30.

* * * * *